US009726364B1

(12) United States Patent
Mart et al.

(10) Patent No.: US 9,726,364 B1
(45) **Date of Patent: *Aug. 8, 2017**

(54) HIGHLY EFFICIENT LED LIGHTING FIXTURE

(71) Applicants: Gary K. Mart, Coral Springs, FL (US); Jose Fernandez, Coral Springs, FL (US)

(72) Inventors: Gary K. Mart, Coral Springs, FL (US); Jose Fernandez, Coral Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/019,311

(22) Filed: Feb. 9, 2016

Related U.S. Application Data

(63) Continuation of application No. 14/259,116, filed on Apr. 22, 2014, now Pat. No. 9,258,855, and a continuation-in-part of application No. 14/658,790, filed on Mar. 16, 2015, and a continuation-in-part of application No. 14/834,687, filed on Aug. 25, 2015, and a continuation-in-part of application No. 14/810,978, filed on Jul. 28, 2015, and a continuation-in-part of application No. 13/731,224, filed on Dec. 31, 2012, now Pat. No. 9,091,424, and a continuation-in-part of application No. 12/996,221, filed on Dec. 3, 2010, now Pat. No. 8,979,304, and a continuation-in-part of application No. 13/730,090, filed on Dec. 28, 2012, now Pat. No. 9,226,356.

(51) Int. Cl.

| | |
|---|---|
| ***F21V 21/00*** | (2006.01) |
| ***F21S 4/00*** | (2016.01) |
| ***F21V 29/61*** | (2015.01) |
| ***F21V 29/78*** | (2015.01) |
| ***H05B 33/08*** | (2006.01) |
| ***F21V 5/04*** | (2006.01) |
| *F21Y 101/02* | (2006.01) |

(52) U.S. Cl.
CPC ..... *F21V 29/61* (2015.01); *F21V 5/04* (2013.01); *F21V 29/78* (2015.01); *H05B 33/0809* (2013.01); *H05B 33/0845* (2013.01); *F21Y 2101/02* (2013.01)

(58) Field of Classification Search
CPC ..... H05B 37/029; H05B 33/0803; H05B 37/0254; H05B 37/02; H05B 33/0818; F21S 4/001; F21S 4/003; F21W 2121/00; F21W 2121/004; F21W 2131/103; F21Y 2101/02; F21K 9/00; F21V 29/004; F21V 15/01
USPC ..... 315/312, 246, 248, 247, 200 R, 224, 315/112–113, 118; 362/249.01, 249.02, 362/249.06, 249.11, 249.14
See application file for complete search history.

(56) References Cited

U.S. PATENT DOCUMENTS

| | | | | |
|---|---|---|---|---|
| 9,258,855 | B1 * | 2/2016 | Mart | F21V 29/025 |
| 2010/0170263 | A1 * | 7/2010 | Steele | F01D 1/026 60/781 |
| 2011/0170263 | A1 * | 7/2011 | Uluc | H05K 7/20218 361/696 |

* cited by examiner

*Primary Examiner* — Minh D A
(74) *Attorney, Agent, or Firm* — Patents on Demand P.A.; Brian K. Buchheit; Scott M. Garrett

(57) ABSTRACT

A highly efficient LED lighting fixture includes a plurality of LEDs and a power converter and control circuit. The power converter circuit is a non-isolated power converter circuit. A heat sink is thermally coupled to a circuit board that carries the power converter, and an AC powered fan directs air over the heat sink to remove heat from the circuit board. The LED lighting fixture has an efficacy of at least 70 lm/w.

20 Claims, 7 Drawing Sheets

700

800

HIGHLY EFFICIENT LED LIGHTING FIXTURE

CROSS REFERENCE

This application is a continuation of U.S. application Ser. No. 14/259,116 (now U.S. Pat. No. 9,258,855) titled "Highly Efficient LED Lighting Fixture" filed Apr. 22, 2014, a continuation in part of U.S. application Ser. No. 14/658,790 titled "An Improved LED Light Having Led Cluster Arrangements" filed Mar. 16, 2015; a continuation in part of U.S. application Ser. No. 14/834,687 titled "An Improved LED Light Having LED Cluster Arrangements filed 25 Aug. 2015; and a continuation in part of U.S. application Ser. No. 14/810,978 titled "LED Light Bulb" filed Jul. 28, 2015. Through these applications, priority is claimed to: U.S. patent application Ser. No. 13/731,224 (now U.S. Pat. No. 9,091,424) entitled "LED LIGHT BULB", filed Dec. 31, 2012; U.S. patent application Ser. No. 12/996,221 (now U.S. Pat. No. 8,979,304) entitled "LED LIGHT BULB", filed Dec. 3, 2010; U.S. application Ser. No. 13/730,090 (now U.S. Pat. No. 9,226,356); provisional application No. 61/059,609, entitled, "LED Light Bulb" filed on Jun. 6, 2009; provisional application No. 61/582,101 entitled "CONTROL AND LIGHTING SYSTEM", filed Dec. 30, 2011. The entire contents of the above (U.S. patent application Ser. Nos. 14/259,111; 14/658,790; 14/834,687; 14/810,978; 13/731,224; 12/996,221; 13/730,090; 61/059,609; and 61/582,101) are incorporated by reference herein in their entirety.

FIELD OF THE DISCLOSURE

The present disclosure relates generally to light emitting diode (LED) lighting devices, and more particularly to techniques, circuits, and methods for making LED fixtures power-efficient.

BACKGROUND

Lighting fixtures and lighting components have been the subject of much interest in the past several years due to the inefficiency of conventional lighting solutions and the development of new lighting technologies. The incandescent light bulb and the common florescent light bulb were used for decades in lighting applications, but new lighting technologies have emerged that use less power to achieve similar light output as those conventional technologies, and they have a longer usage life. Among these are light emitting diode (LED) lighting fixtures.

LEDs are solid state electronic devices that convert electric power to light significantly more efficiently that either incandescent of florescent bulbs. However, they are driven using a direct current (DC) instead of an alternating current (AC). Accordingly, a power converter is required to convert the commercial AC service to an appropriate DC level for an LED fixture. Furthermore, a single LED requires only about one to two volts to operate, which is significantly less than the voltage supplied by commercial electrical service (e.g. 110 or 220 VAC) when rectified to a DC voltage, which can be on the order of 155 volts DC for 110 VAC service, or 311 volts DC for 220 VAC service. Converting DC at those levels down to ~2 volts DC would result in substantial losses in the conversion circuitry.

The power conversion represents a source of inefficiency and produced heat as a result. Heat is detrimental to the operation and life of the electronic components used to control the LEDs in an LED lighting device. The conventional approach to dealing with the heat issue is to use an independent power converter that is physically separated from the LED circuitry, where power is provided over wiring to the LED fixture from the remotely located power supply. This requires the LED fixture and power supply to be packaged separately, and installed separately. The packaging, installation, sourcing and other considerations associated with having a separate power converter can add to the cost of installing LED fixtures in commercial applications. Another issue with LED lighting fixtures has been that they typically do not meet lighting output requirements for some industrial and commercial applications which are conventionally met using high power halogen and other high output light sources. Some manufacturers have tried simply grouping a high number of LEDs together in a confined area, but the heat generated by a close grouping of LEDs has tended to defeat the benefits of using LED light fixtures.

Accordingly, there is a need for a highly efficient LED lighting fixture that can meet high output lighting requirements and still maintain the power savings and long life benefits normally associated with LED lighting.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
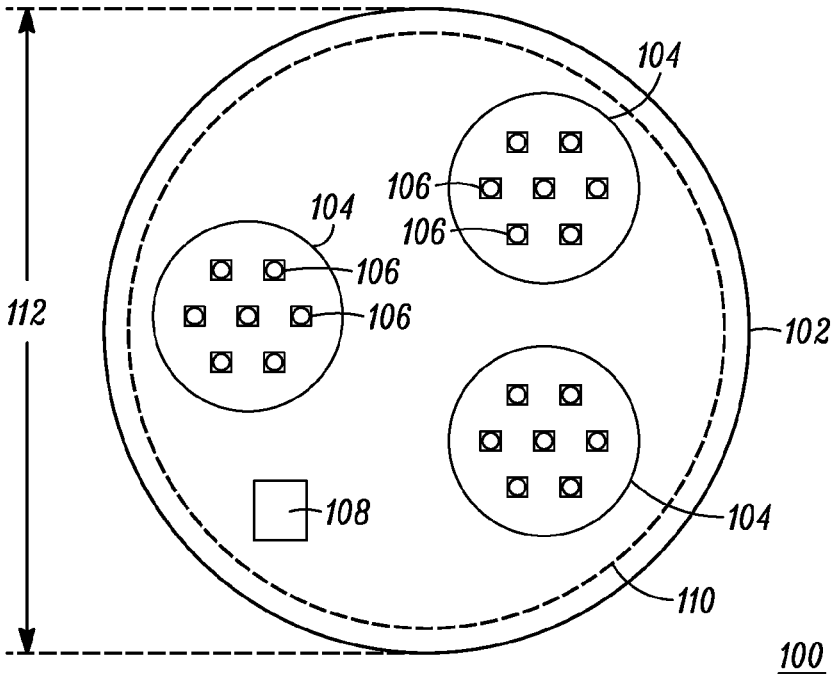
FIG. 1 is a top view of a circuit board for an LED lighting fixture in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

Embodiments include a light emitting diode (LED) lighting fixture that includes a circuit board on which is mounted a plurality of LEDs, and a non-isolated power regulator that converts a standard AC source to a DC level to drive the LEDs to a selected output level. The LED lighting fixture further includes a heat sink that is thermally coupled to the circuit board and has a plurality of fins on a side of the heat sink opposite that of a side that is thermally coupled to the circuit board. The LED fixture further includes an AC fan that is powered by the AC source and that is coupled to the heat sink to direct ambient air over the heat sink, and a cover that fits over the circuit board and has one or more openings over the LEDs to accept a lensing component. In embodiments this arrangement of elements can produce an LED lighting fixture in a standard PAR38 configuration that has an efficacy of at least 70 lumen output by the LEDs for each Watt of power consumed from the AC source.

FIG. 1 is a top view 100 of a circuit board 102 for an LED lighting fixture in accordance with some embodiments. The circuit board 102 is generally circular, and can be sized to fit into an existing fixture that accepts PAR38 bulbs. As such, the circuit board 102 has a diameter 112 that does not exceed 4.75 inches (for PAR38 applications). The circuit board carries one or more LED clusters 104, each cluster being comprised of a plurality of LEDs 106. In some embodiments there can be three clusters arranged at 120 degrees from each other (with respect to the center of the circuit board 102), with each cluster having 7 LEDs arranged with one LED in the center of the cluster and 6 LEDs arranged around the center LED in a circular arrangement. The circuit board 102 also carries circuitry components 108 that can include a non-isolated power supply circuit that converts commercial AC voltage to a DC voltage useable by the LEDs, and regulation circuitry to control the electric current through the LEDs. By "non-isolated" it is meant that there is no isolation transformer as is common in power converters where there is isolation between a high voltage, primary side and a low voltage, secondary side. Rather, the circuitry 108 directly converts the AC supply to a DC voltage at a high level, and controls current from that high DC level through the LEDs 106 without an isolated power configuration. In some governmental jurisdiction or other defined regions a non-isolated power conversion arrangement requires particular spacing requirements, such as, for example, maintain a spacing distance 110 from an edge of the circuit board. Such spacing requirements are necessary for safety approvals and certifications for commercial sale and use. By using a non-isolated arrangement the losses associated with isolation transformers and switching are substantially avoided, which contributes to increasing the overall efficiency of a lighting fixture using the circuit board 102. The arrangement of the LEDs and the non-isolated power conversion arrangement can, in some embodiments, allow the LED lighting fixture to achieve an efficacy of over 80 lumen per watt (lm/w). The circuit board 102 can be assembled using only surface mount components on one side (the side shown) of the circuit board for 110 VAC models. Alternatively, in some models, a certain filter capacitance can be implemented as a leaded component on the opposite side of the circuit board 102 in a convenient location, such as the center of the board 102 to avoid using several smaller surface mount capacitances to meet packaging requirements.

Thus, the circuit board 102 is self-contained, and includes all circuitry necessary to operate the LEDs 106 and provide lighting when supplied with commercial AC voltage. No separate power supply is required, which means no power supply installation is required in commercial lighting applications, and no separate packaging, shipping other costs associated with separate power supplies of the prior art lighting fixtures are incurred when installing a lighting fixture using a circuit board in accordance with the embodiments of FIG. 1.

Figure 2:
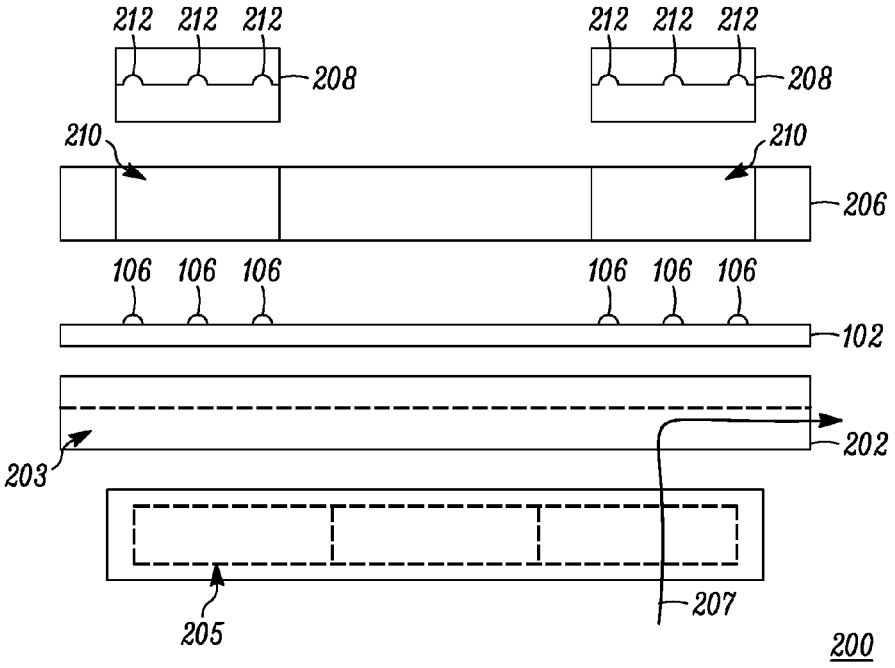
FIG. 2 is a side view of an LED lighting fixture in accordance with some embodiments.
Figure 3:
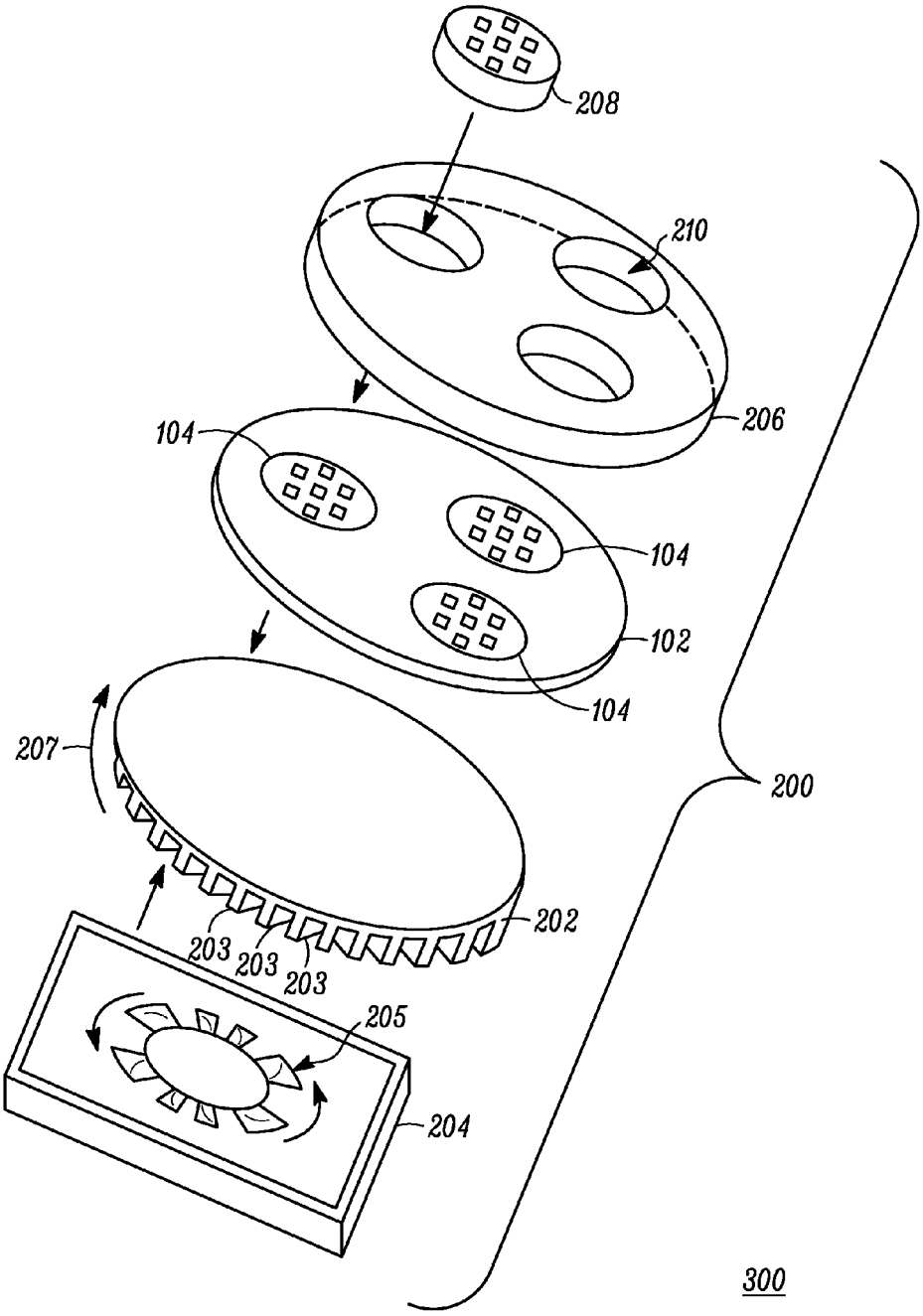
FIG. 3 is an isometric exploded view of an LED lighting fixture in accordance with some embodiments.
Figure 8:
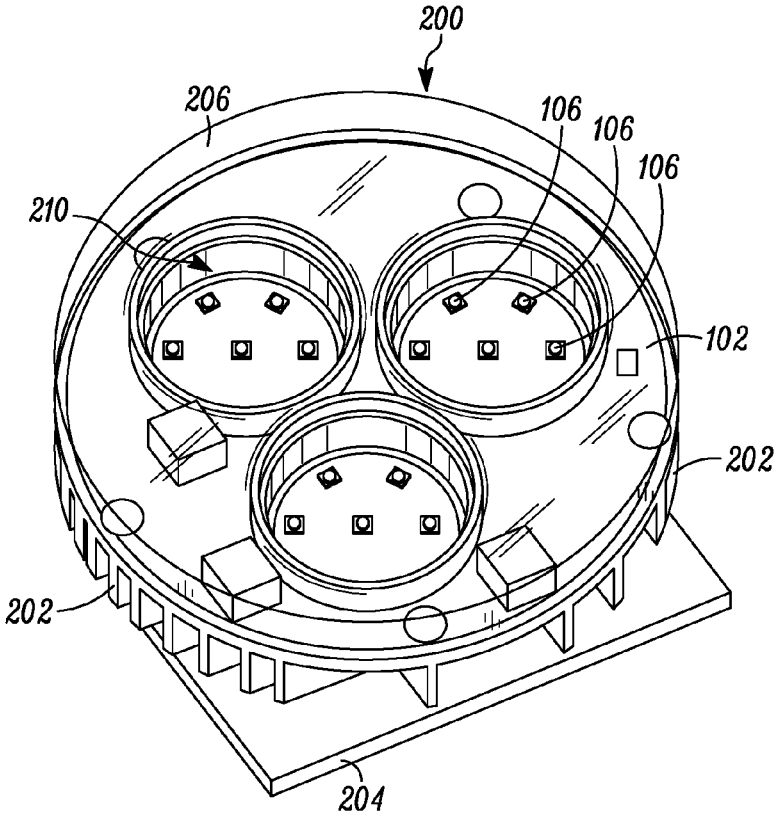
FIG. 8 is an isometric view of an assembled LED lighting fixture in accordance with some embodiments.

FIG. 2 is a side view of an LED lighting fixture 200 in accordance with some embodiments. FIG. 3 is an exploded isometric view 300 of the same LED lighting fixture 200. FIG. 8 is an isometric view 800 of an assembled LED lighting fixture 200, as also shown in FIGS. 2-3, in accordance with some embodiments. The LED lighting fixture 200 is shown in exploded view, and the major components are shown spaced apart here.

Figure 9:
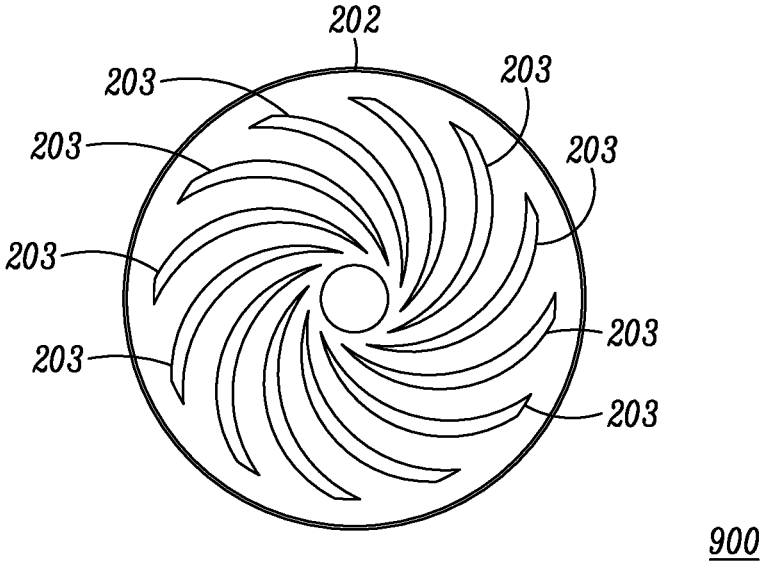
FIG. 9 shows a bottom view of a heat sink having spiral arced fins in accordance with some embodiments.

The LED lighting fixture 200 includes several components in addition to the circuit board 102 with LEDs 106 and the non-isolated power converter circuitry and other circuitry. The LED fixture 200 includes a heat sink 202 that is used to remove and dissipate heat produced by circuitry on the circuit board 102. The heat sink 202 is placed in contact with backside of the circuit board 102 in order to draw heat from the circuit board. The contact can be enhanced with the use of compliant, thermally conductive material placed between the circuit board 102 and the heat sink 202. The heat sink 202 can have a plurality of spiral-radial fins 203, which run from an outer periphery of the heat sink 202 towards the center of heat sink along an arced path such as that taught in co-pending U.S. patent application Ser. No. 13/729,859, titled "AN IMPROVED HEAT SINK FOR AN LED LIGHT FIXTURE," assigned to the assignee of the present application, the entire disclosure of which is hereby incorporated by reference. FIG. 9 shows a bottom view 900 of the heat sink 202. The fins 203 can be uniform in thickness along their respective arcs, or they can taper, and shorter fins can be interspersed with longer fins. The spiral fins facilitate a circular movement of air around the LED fixture 200 (i.e. horizontal, and into and out of the page in FIG. 2) when placed in, for example, a PAR38, or equivalent, housing.

A fan is used to move air through the heat sink. In some embodiments an AC fan 204 is used. The AC fan 204 has a fan member 205 which draws ambient air through the fan 204, into the heat sink 202, where the fins 203 redirect the air into a circular or arced direction around the heat sink 202 (i.e. into and out of the page as shown) I the direction of arrow 207. The AC fan is driven directly from the AC service, rather than being DC driven, to further increase efficiency. Use of a DC converter to supply a DC powered fan would incur additional conversion inefficiency. The height of the fan 204 and heat sink 202 must be selected so that the LED fixture 200, when assembled, will fit into the desired housing.

To further increase efficiency, the LEDs 106 can be connected in series. In an embodiment using 21 LEDs 106, with approximately 2 volts across each LED, the total voltage necessary to drive the LEDs 106 is then 42 volts. Thus, rather than converting, for example, 110 VAC to 155 volts DC, and then to 2 volts DC, assuming all the LEDs 106 were electrically connected in parallel, the non-isolated power converter only has to convert down to approximately 42 volts to drive the LEDs 106 in such an embodiment. The number of LEDs 106 used is dependent on the desired light intensity output, as well as the efficiency of the LEDs 106 in converting electric power into light. In some embodiments fewer LEDs 106 may be used, in some embodiments more LEDs 106 may be used that the embodiments using twenty one LEDs 106 as shown here.

In some embodiments a cover 206 fits over the circuit board 102, and includes openings 210 into each of which a lensing assembly 208 can be inserted, or removed therefrom. The lensing assemblies 208 can be formed of a transparent material, and have lensing elements 212 to focus light emitted from the LEDs, and accordingly are mounted in physical correspondence with the LEDs. The lensing elements 212 are formed to each align with a corresponding LED 106, and to focus or spread the light produced by the LEDs 106 in a desired manner. The lensing assemblies 208 can be selected to have different angles to produce, for example, a flood effect, a spot effect, or other light directing forms. By separating the lensing assemblies 208 from the cover, they can be changed to suit a particular application. Thus in some applications lensing assemblies 208 can be selected to provide a desired spot effect, such as applications where the fixture is mounted high up over an area to be illuminated, and in some applications lensing assemblies 208 can be selected to provide a desired flood effect, such as applications where the fixture is mounted low over an area to be illuminated.

Figure 4:
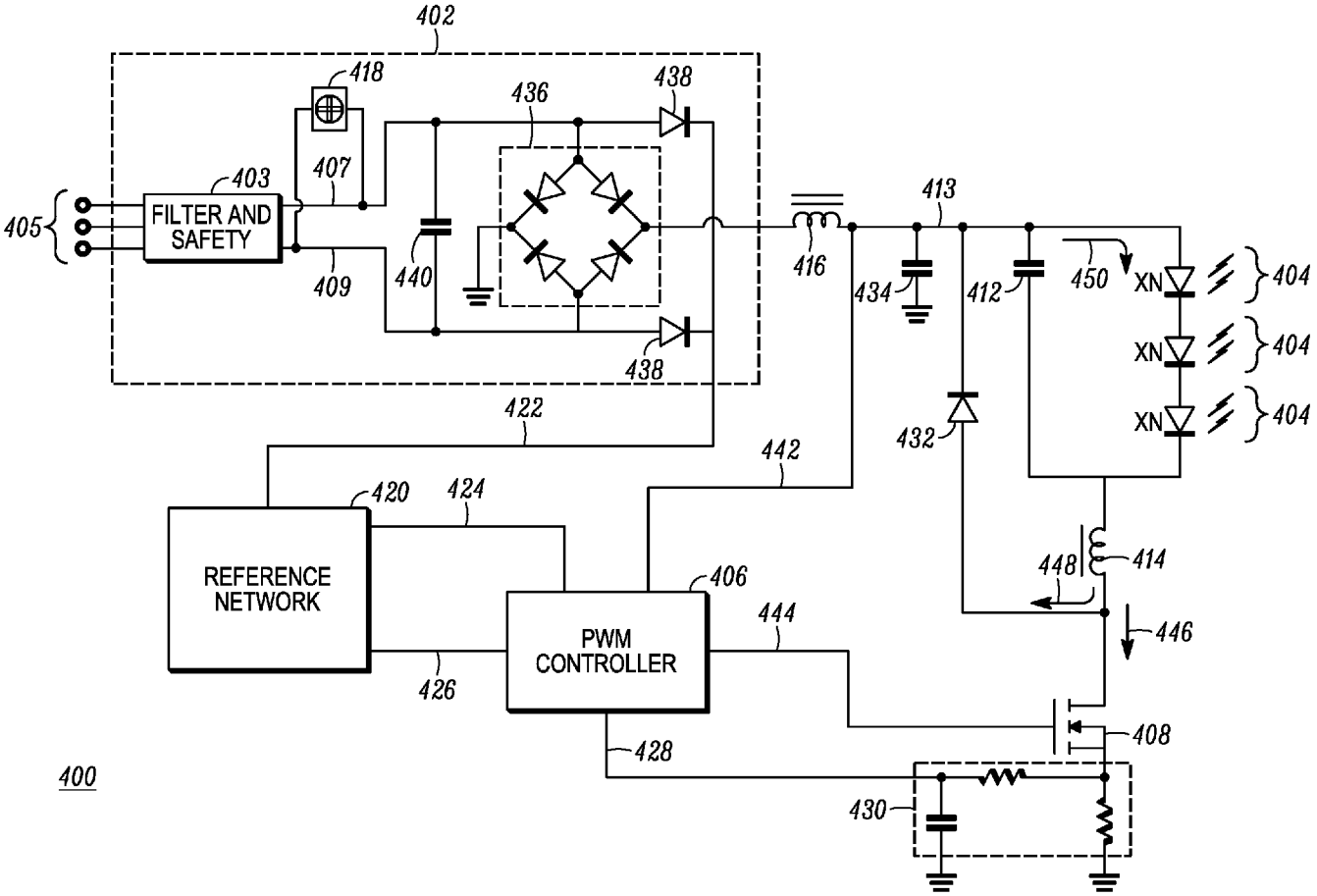
FIG. 4 is a schematic diagram of a power and control circuit for an LED lighting fixture in accordance with some embodiments.

FIG. 4 is a schematic diagram of a power and control circuit 400 for an LED lighting fixture in accordance with some embodiments. The circuit 400 uses a non-isolated power converter, and can be used to power, for example, LED fixture 200 of FIG. 2. Accordingly, the circuit 400 includes an AC processing section 402 which rectifies and filters the an input AC power signal, such as a commercial 110 VAC source. The AC processing section can include a filter and safety section 403, which filters the AC input, as well as reverse conducted signals to prevent noise generated by the control circuit 400 from conducting back into the AC service network. The filter and safety section 403 can also include components to handle voltage spikes or surges (i.e. lighting protection) that may occur on the AC input 405. The AC input 405 can include a three terminal input, including phase, neutral, and earth ground terminals, as is well known. The output of the filter and safety section 403 is a filtered AC voltage between lines 407, 409. A pair of rectifiers 438, one on each line 407, 409, rectify the AC voltage between lines 407, 409 to provide a first DC output on line 422. A rectifier bridge 436 also rectifies the AC voltage between lines 407, 409 and provides a second DC output 413 through filter inductor 416 and bulk filter capacitor 434. An AC fan 418 can be connected across lines 407, 409 to cool the fixture, and can be, for example, fan 204 of FIG. 2.

A plurality of LEDs can be connected in series at the second DC output 413. By connecting the LEDs in series, the voltage drop needed across each individual LED can be summed Thus the LEDs can be, in some embodiments, arranged in a plurality of LED clusters 404, which each include a plurality of N individual LEDs that are connected in series. Three such LED clusters 404 are shown here. If, for example, each LED cluster 404 has seven individual LEDs, then there will be 21 LEDs connected in series, total, for the three LED clusters. Each LED cluster 404 represents a separate physical co-location of LEDs. Thus, continuing with the example, seven LEDs are grouped together on a region of a circuit board using the control circuit 400 for the LED fixture, and there are three such groupings in the present example. By connecting all the LEDs of the LED clusters 404 in series in some embodiments, the resulting voltage needed to drive them increases towards the voltage level of the second DC output 413. Using, for example, twenty one LEDs, (three clusters of seven LEDs), a total voltage of about 42 volts is needed to drive the LEDs to emit substantial light at a nominal operating condition. It will be appreciated by those skilled in the art that other arrangements can be configured. For example, there can be a separate DC-DC converter for each separate cluster of LEDs in some embodiments, rather than connecting all LEDs in series.

Current through the LEDs is controlled by a switched mode converter that can include a pulse width modulation (PWM) controller 406, a switch transistor 408, inductance 414, and free wheel diode 432. The PWM controller can be, in some embodiments, an AL9910 series LED driver manufactured by Diodes, Inc., or the equivalent. The PWM controller 406 drives the switch transistor 408 using drive line 444. When the switch transistor 408 is turned on, current flows through the LEDs and inductance 414 in the direction of arrows 446, 450, and the free wheel diode 432 is reverse biased. When the switch transistor 408 is shut off, the magnetic field of inductance 414 begins collapsing, causing the voltage across it to reverse, and causing current forward bias the free wheel diode 432 and flow through the free wheel diode in the direction of arrow 448, 450. Thus, current is maintained through the LEDs when the switch transistor 408 is shut off. The PWM controller 406 receives a current sense signal on line 428 from a current sense circuit 430 that indicates the current through the inductance 414. The current sense circuit 430 can integrate the voltage across a sense resistor that is in series with the switch transistor 408 to produce the current sense signal 428. Thus, the PWM controller 406 can regulate the current through the LEDs to achieve a desired output since the light output of the LEDs varies (non-linearly) with the amount of current through the LEDs, and current only flows through the LEDs when voltage across each LED is sufficient to forward bias the LED. The PWM controller 406 is supplied with a dimming signal 424 and an enable signal 426. The dimming signal 424 sets the current limit threshold used to control the current through the LEDs based on the supplied voltage, and therefore the light output of the LEDs. The reference network 420 can include circuitry that adjusts the dimming signal in response to, and in correspondence with a clipped AC waveform at the input terminals 405, as would be produced by a commonly available dimmer switch, which allows a user to adjust the light output. The more the AC source 405 is clipped, the lower the dimming signal level will be, and the switched mode converter will correspondingly draw less current through the LEDs. The reference network 420 can also determine whether the input AC at terminals 405 is 110 VAC or 220 VAC, and adjusts operation accordingly. The enable signal 426 enables the PWM operation when the first DC voltage 422 is sufficiently high to commence operation. Thus, once the input AC voltage is sufficiently high, i.e. high enough to produce a sufficient DC voltage to drive all of the LEDs, the PWM operation can be enabled. The level of current can then be varied with the level of, for example, the first DC voltage 422. And the first DC voltage 422 increases, the PWM controller 406 can correspondingly increase the current through the LEDs.

In some embodiments each cluster of LEDs can be regulated by a separate DC-DC converter, which includes, for example, an inductor such as inductor 448, a switch such as switch 408, and current sense circuit such as current sense circuit 430, a PWM controller such as PWM controller 406, and so on, as is needed to regulate current through each individual LED cluster 404. By using separate DC-DC converters for each individual LED cluster 404, the size of the components (i.e. the inductor 448) can be reduced, allowing for a lower profile of the circuit components on the circuit board 202.

Figure 5:
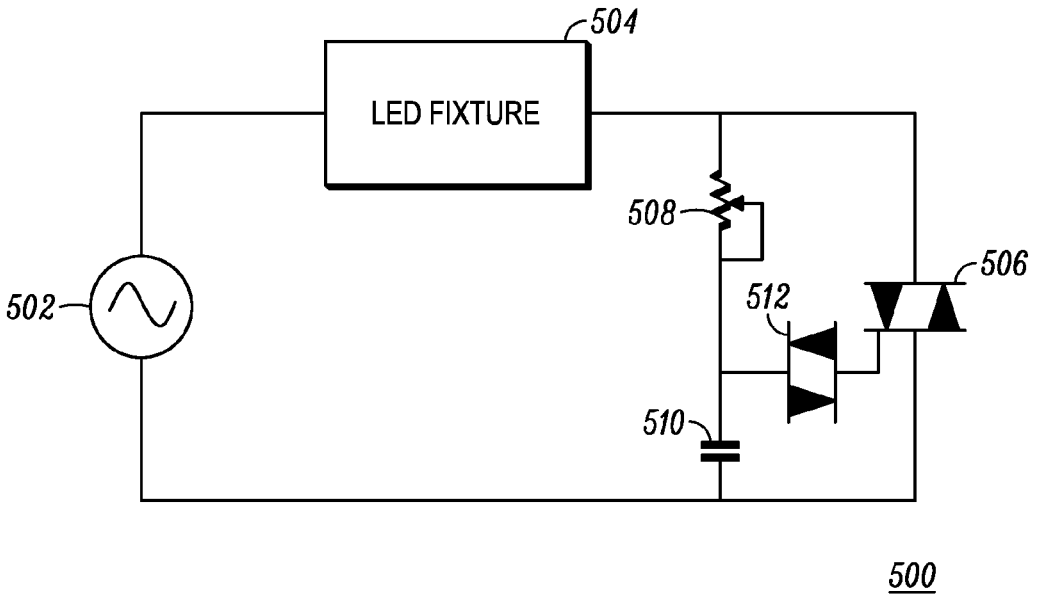
FIG. 5 is a schematic diagram of a dimming circuit for use with an LED lighting fixture in accordance with some embodiments.

FIG. 5 is a schematic diagram of a dimming circuit 500 for use with an LED lighting fixture in accordance with some embodiments. An advantage of using the non-isolated power converter, such as that shown in FIG. 4, to power the LEDs of the LED fixture is that the LED lighting fixture can be used with a conventional dimmer circuit, such as one that may already be in place prior to installing the LED lighting fixture. A conventional dimmer reduces the AC level supplied to the a device or circuit, such as the LED fixture 504. An AC source 502 can be provided to the LED lighting fixture 504. The AC source 502 is a commercial AC power source (i.e. 110 VAC, or 220 VAC). The LED lighting fixture 504 can be substantially that as shown in FIGS. 1-4, and is connected in series with a dimmer control circuit through wiring. The dimmer control circuit includes a TRIAC 506, which is a voltage controlled semiconductor. In parallel with the TRIAC 506 is a series connected potentiometer 508 and capacitor 510. The potentiometer is a variable resistance that is controlled by a user through mechanical means (e.g. rotating a knob or moving a slide). A DIAC 512 is connected between the node joining the potentiometer 508 and capacitor 510 and a control input of the TRIAC 506. By setting the potentiometer 508, the user can control the point of an AC wave where the TRIAC 506 conducts. Circuitry in the LED lighting fixture 504 can detect the reduced (clipped) AC voltage such as using circuitry in the reference network 420 of FIG. 4, and reduce the current through the LEDs in correspondence with the changes in input AC power voltage.

Figure 6:
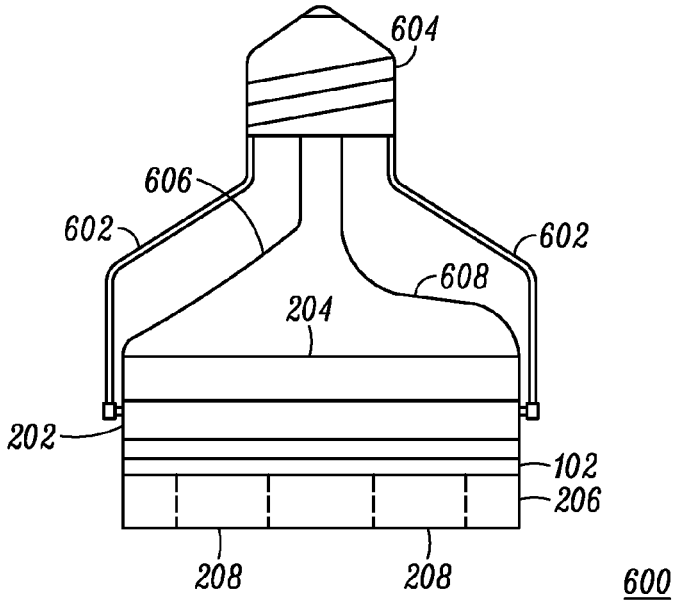
FIG. 6 is a side view of a yolk assembly of an LED lighting fixture in accordance with some embodiments.

FIG. 6 is a side view of a yolk assembly 600 of an LED lighting fixture in accordance with some embodiments. The yolk assembly 600 can be, in some embodiments, a PAR38-packaged LED lighting fixture including. The yolk assembly include support structures 602 connected to a conventionally sized screw-in bulb tip 604 that can be screwed into a standard light bulb power socket. The supports structures 602 can be further coupled to the heat sink 202 in a manner that allows the LED fixture to be tilted. Since the LED lighting fixture does not need an external power source to supply DC power, the AC source can be obtained from the light socket and provided to the circuit board 102 and fan 204 via wires 606, 608, which can be, for example, the phase and neutral terminals of commercial AC service. The LED lighting fixture can be housed in unitary package in compliance with the dimensions for a PAR38 bulb and meeting all standards for such bulbs. PAR38 is an industry standard, and refers to the parabolic aluminized reflector lamp bulb standards. A PAR38 bulb is 4.75 inches in diameter, and can be used in housings, referred to as "cans," rated up to 150 watts of power dissipation.

Figure 7:
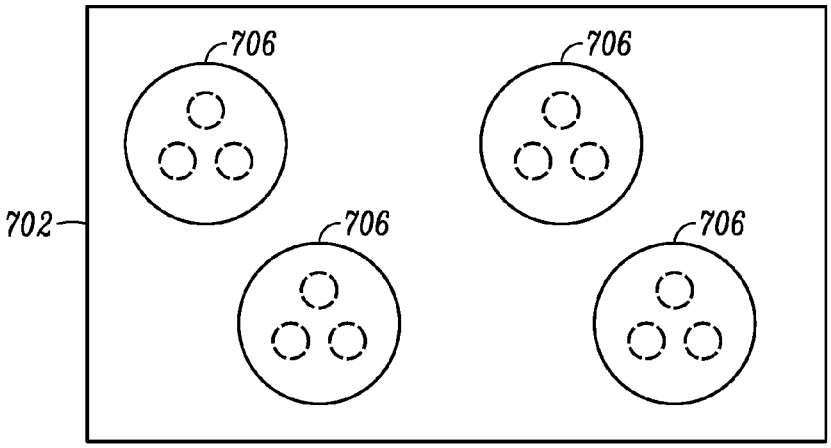
FIG. 7 is a modularized panel including several LED lighting fixtures grouped together in the panel in accordance with some embodiments.

FIG. 7 is an alternative housing arrangement and configuration for an LED fixture, in accordance with some embodiments, and includes a modularized panel 700 in a housing 702 that contains several LED lighting fixtures 706 grouped together in the panel 700 in accordance with some embodiments. The panel 700 can be used to replace an existing conventional lighting fixture, such as for high elevation applications. Each of the several LED fixtures 706 can be a LED fixture such as that shown in FIGS. 1-3, and can be packaged in a PAR38 complaint configuration. Thus, the panel 700 can comprise a plurality of PAR38 bulbs, which can be highly efficient LED lighting fixtures.

The benefits of an LED lighting fixture designed in accordance with the teachings herein are an increase in efficiency and efficacy. The Applicant has constructed LED lighting fixtures in a PAR38 bulb compliant package that have achieved over 80 lm/w efficacy and in cases closer to 90 lm/w efficacy. This represents an improvement of over 25% efficacy over other known LED lighting fixtures in PAR38 compliant packaging. A LED lighting fixture designed in accordance with the disclosed embodiments avoids the need for an external AC to DC power source and can be used as a direct replacement for AC-powered bulbs. Furthermore, the LED lighting fixture can operate using both 110 VAC and 220 VAC input, it will operate with existing conventional dimmers, it can be lensed for different applications by changing only the lensing components, and it can be arranged with other such units in panels or other cluster arrangements.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A light fixture, comprising:

a circuit board;

a plurality of light emitting diodes (LEDs) disposed on the circuit board arranged into at least three clusters of LEDs with a plurality of at least four LEDs within each cluster, wherein the three clusters are connected electrically in series, wherein each of the LED clusters is arranged with one LED in a center of the respective LED cluster with a remaining portion of the plurality of LEDs arranged substantially in a circle around the LED in the center of the cluster;

a power circuit that converts a commercial alternating current (AC) source to a direct current (DC) voltage and includes a circuit that controls current through the LEDs; and a heat sink that is thermally coupled to the circuit board; and an AC fan that is powered by the AC source to move air over the heat sink, wherein the light fixture has an efficacy of at least 70 lumen per watt of power consumed from the AC source.

2. The light fixture of claim 1, wherein the plurality of LEDs are connected in series.

3. The light fixture of claim 1, wherein the power circuit is a non-isolated power converter.

4. The light fixture of claim 1, further comprising a reference network that provides a dimming signal to the switched mode converter that causes the switched mode converter to draw current through the LEDs in correspondence with the dimming signal.

5. The light fixture of claim 4, wherein the reference circuit adjusts the dimming signal in correspondence with the AC source being clipped to adjust the current through the plurality of LEDs in correspondence with an amount of clipping of the AC source.

6. The light fixture of claim 1, wherein the at least three clusters are arranged substantially in a circle and are spaced an equal distance from each other.

7. The light fixture of claim 1, wherein the at least three clusters includes four or more clusters, one cluster of the four or more clusters is arranged in a center with remaining ones of the four or more clusters arranged substantially in a circle around the one LED cluster in the center.

8. The light fixture of claim 1, wherein the heat sink comprises arced fins facing the AC fan.

9. The light fixture of claim 1, wherein the light fixture is housed in a PAR 38 bulb configuration.

10. The light fixture of claim 1, further comprising:

a cover disposed over the circuit board having a plurality of openings formed therein, each opening corresponding to one of the plurality of LED clusters.

11. The light fixture of claim 1, further comprising:

a plurality of removable lensing assemblies, one per cluster.

12. A light fixture, comprising:

a circuit board;

a plurality of light emitting diodes (LEDs) disposed on the circuit board arranged into at least three clusters of LEDs with a plurality of at least four LEDs within each cluster, wherein the three clusters are connected electrically in series, wherein each of the LED clusters is arranged in a circle about a center of the respective LED cluster;

a power circuit that converts a commercial alternating current (AC) source to a direct current (DC) voltage and includes a circuit that controls current through the LEDs; and a heat sink that is thermally coupled to the circuit board; and an AC fan that is powered by the AC source to move air over the heat sink, wherein the light fixture has an efficacy of at least 70 lumen per watt of power consumed from the AC source.

13. The light fixture of claim 12, wherein the plurality of LEDs are connected in series.

14. The light fixture of claim 12, wherein the at least three clusters are arranged substantially in a circle and are spaced an equal distance from each other.

15. The light fixture of claim 12, further comprising:

a cover disposed over the circuit board having a plurality of openings formed therein, each opening corresponding to one of the plurality of LED clusters.

16. A light bulb, comprising:

a bracket;

a housing translatably coupled with the bracket, the housing having:

a circuit board;

a plurality of light emitting diodes (LEDs) disposed on the circuit board arranged into at least three clusters of LEDs with a plurality of at least four LEDs within each cluster, wherein the three clusters are connected electrically in series, wherein each of the LED clusters is arranged with one LED in a center of the respective LED cluster with a remaining portion of the plurality of LEDs arranged substantially in a circle around the LED in the center of the cluster;

a power circuit that converts a commercial alternating current (AC) source to a direct current (DC) voltage and includes a circuit that controls current through the LEDs; and a heat sink that is thermally coupled to the circuit board; and a fan to move air over the heat sink, wherein the light fixture has an efficacy of at least 70 lumen per watt of power consumed from the AC source.

17. The light bulb of claim 16, wherein the housing is at least one of slidably coupled and rotatably coupled with the bracket.

18. The light bulb of claim 16, wherein the at least three clusters are arranged substantially in a circle and are spaced an equal distance from each other.

19. The light bulb of claim 16, wherein the clusters are disposed on a front face of the housing arranged to generate light in a direction away from the front face of the housing, said housing further comprising:

a rear face of the housing with the heat sink thermally integrated into the housing;

the heat sink including at least one heat dissipating member extending outwardly from the rear face of the housing to dissipate heat generated by the at least one light emitting diode (LED) unit; and the fan being attached to the rear face of the housing, the fan operably configured to generate airflow that removes the heat generated by the clusters.

20. The light bulb of claim 16, further comprising:

a plurality of removable lensing assemblies, one per cluster.

* * * * *